US008074470B2

(12) United States Patent
Maier-Laxhuber et al.

(10) Patent No.: US 8,074,470 B2
(45) Date of Patent: Dec. 13, 2011

(54) SORPTION COOLING ELEMENT WITH REGULATOR ORGAN AND ADDITIONAL HEAT SOURCE

(75) Inventors: Peter Maier-Laxhuber, Pfaffenhofen (DE); Ralf Schmidt, Freising (DE); Reiner Wörz, Reichertshausen (DE); Andreas Becky, Ottobrunn (DE); Gert Richter, Klitten (DE); Norbert Weinzierl, Freising (DE); Manfred Binnen, München (DE)

(73) Assignee: ZEO-TECH Zeolith-Technolgie GmbH, Unterschleissheim (DE)

( * ) Notice: Subject to any disclaimer, the term of this patent is extended or adjusted under 35 U.S.C. 154(b) by 674 days.

(21) Appl. No.: 12/040,040

(22) Filed: Feb. 29, 2008

(65) Prior Publication Data

US 2008/0216508 A1 Sep. 11, 2008

(30) Foreign Application Priority Data

Mar. 5, 2007 (DE) ..... 10 2007 010 981
Nov. 30, 2007 (DE) ..... 10 2007 057 748

(51) Int. Cl.
*F25B 17/00* (2006.01)

(52) U.S. Cl. ..... 62/480

(58) Field of Classification Search ..... 62/101, 62/141, 238.3, 457.9, 478, 451, 463, 479–497, 62/515–524; 428/317.9; 165/61
See application file for complete search history.

(56) References Cited

U.S. PATENT DOCUMENTS 3,464,486 A * 9/1969 Whitney et al. ..... 165/103
3,912,005 A * 10/1975 Griffiths ..... 165/169
4,479,364 A 10/1984 Maier-Laxhuber
4,660,629 A 4/1987 Maier-Laxhuber et al.
4,674,563 A 6/1987 Maier-Laxhuber et al.
4,752,310 A 6/1988 Maier-Laxhuber et al.
4,802,341 A 2/1989 Maier-Laxhuber et al.
4,886,178 A * 12/1989 Graf ..... 215/247
4,924,676 A 5/1990 Maier-Laxhuber et al.
4,956,977 A 9/1990 Maier-Laxhuber et al.
5,038,581 A * 8/1991 Maier-Laxhuber et al. . 62/457.9
5,050,403 A 9/1991 Maier-Laxhuber
5,054,544 A 10/1991 Maier-Laxhuber et al.
5,207,073 A 5/1993 Maier-Laxhuber et al.
5,359,861 A 11/1994 Maier-Laxhuber et al.
5,404,728 A 4/1995 Maier-Laxhuber
5,415,012 A 5/1995 Maier-Laxhuber et al.
5,440,896 A 8/1995 Maier-Laxhuber et al.
5,482,541 A 1/1996 Maier-Laxhuber et al.
5,518,069 A 5/1996 Maier-Laxhuber et al.
(Continued)

FOREIGN PATENT DOCUMENTS

WO WO /99/07958 7/1999
(Continued)

*Primary Examiner* — Frantz Jules
*Assistant Examiner* — Emmanuel Duke
(74) *Attorney, Agent, or Firm* — Hoffmann & Baron, LLP

(57) ABSTRACT

A cooling element with a sorption agent, that under vacuum can sorb a vapor-like working agent that evaporates from a liquid working agent in an evaporator and with a regulator organ in a working agent vapor channel between the sorption agent and the evaporator, wherein the entire cooling element is hermetically enclosed by a gas-tight multi-layer film, the multi-layer film has a flexible construction and is under vacuum so encloses the regulator organ, the working agent vapor channel and the evaporator, that the evaporator and the working agent vapor can flow to the sorption agent only through the regulator organ.

23 Claims, 7 Drawing Sheets

U.S. PATENT DOCUMENTS

| | | | | |
|---|---|---|---|---|
| 5,816,069 | A | 10/1998 | Ebbeson | |
| 6,341,491 | B1 | 1/2002 | Paine et al. | |
| 6,349,560 | B1 | 2/2002 | Maier-Laxhuber et al. | |
| 6,378,326 | B2 | 4/2002 | Maier-Laxhuber et al. | |
| 6,412,295 | B2 | 7/2002 | Weiss et al. | |
| 6,474,100 | B1 | 11/2002 | Smith et al. | |
| 6,820,441 | B2 | 11/2004 | Maier-Laxhuber et al. | |
| 2003/0014982 | A1 * | 1/2003 | Smith et al. | 62/106 |
| 2003/0033829 | A1 * | 2/2003 | Smith et al. | 62/480 |
| 2004/0157018 | A1 * | 8/2004 | Lyublinski et al. | 428/35.7 |
| 2004/0211215 | A1 * | 10/2004 | Maier-Laxhuber et al. | 62/480 |
| 2006/0191287 | A1 | 8/2006 | Maier-Laxhuber | |

FOREIGN PATENT DOCUMENTS

| | | | |
|---|---|---|---|
| WO | WO 01/10738 | A1 | 2/2001 |

* cited by examiner

SORPTION COOLING ELEMENT WITH REGULATOR ORGAN AND ADDITIONAL HEAT SOURCE

BACKGROUND OF THE INVENTION

The invention concerns a sorption cooling element with a regulator organ and with a gas-tight multi-layer film for cooling wherein by vapourising a working agent and subsequent sorption of the working agent vapour in a sorption agent under vacuum cold is produced. At the same time the evaporator has a flexible construction to enable to adjust it to suit various cooling tasks.

Sorption cooling elements are devices, in which a solid adsorption agent in the form of vapour sorbs a second agent, the working agent, which boils at lower temperatures while releasing heat (sorption phase). In doing so the working agent is evaporated in an evaporator while taking up heat. Once the adsorption agent is saturated, it can be again desorbed at higher temperature by heat input (desorption phase). At the same time working agent evaporates from the adsorption agent. The working agent vapour can be reliquefied and subsequently evaporated again.

Adsorption devices for cooling with solid sorption agents are known from EP 0 368 111 and DE-OS 34 25 419. Sorption agent containers, filled with sorption agents, draw off the working agent vapour emerging in an evaporator and sorb it while releasing heat. At the same time the sorption heat has to be removed from the sorption agent. The cooling devices can be used for cooling food and keeping it hot in thermally insulated boxes.

WO 01/10738 A1 describes a self-cooling beverage can wherein the evaporator is provided within and a sorber outside of the can. The cooling is started by opening a vapour channel between the evaporator and the sorber. The cold, produced in the evaporator, is transferred over its surface to the beverage to be cooled inside the can. The heat emerging in the sorption agent is stored in a heat buffer. The self-cooling beverage can is strongly modified in comparison with a conventional can and is expensive to produce.

Further, more theoretical configurations of self-cooling barrels are compiled in WO 99/37958 A1. None of the devices can be cost-effectively materialized and manufactured.

Finally, U.S. Pat. No. 6,474,100 B1 describes a self-cooling cooling element on the exterior of a bag for liquids or loose goods. On this occasion the sorption agent is enclosed in a flexible, multi-layer film. The contact with the hot sorption fill is reduced to a minimum by insulating and flow materials as well as by heat-storing masses situated between them. The temperature equalization between the hot sorber fill and the cold evaporator, which lie against one another with a large surface, has to be reduced by using an elaborate insulation.

DE 10 2005 034297 A1 describes a sorption cooling element with a gas-tight film wherein a sorption agent is filled in a gas-tight bag for the sorption agent, that for the purpose of starting the cooling function is cut by a cutting tool. A control of the cooling capacity is thus impossible.

SUMMARY OF THE INVENTION

The object of the invention is to provide cost-effective sorption cooling elements for single-use, wherein the cooling can be controlled.

According to the invention the individual components of a cooling element are so sealed under vacuum in a gas-tight, flexible multi-layer film that the working agent vapour, flowing from the liquid working agent, can flow to the sorption agent only through the working agent vapour channel and the regulator organ. The deforming forces, produced by the external air pressure, have to suffice to nestle the multi-layer film around the individual components in such a manner that no path will remain open for the working agent vapour to bypass the regulator organ. Thus the individual components do not have to be joined gas-tight with one another. They only need to be placed into a bag, produced from the multi-layer film and fixed until the bag under the affect of the vacuum abuts firmly against the components and only the working agent vapour channel remains open.

According to the invention the regulator organ can be easily opened and closed by deforming the multi-layer film. Elaborate vacuum ductings are therefore not required.

In a particularly advantageous manner the regulator organ can be formed from a valve seat and a sealing plane matching it. The regulator organ can be opened and closed through the multi-layer film via a lever mechanism and, if required, also used to control the performance. There are no further spring elements required to press the sealing plane against the valve seat when the flexible film so abuts against the sealing plane that the external air can suitably effectively act upon the valve.

In an advantageous manner the hoses used for the working agent vapour channels are such, which withstand the external pressure, but not an additional pressure, e.g. one produced by a squashing tool, that acts externally on the multi-layer film and so strongly squashes the hose that the flow path would be blocked.

A further very cost-effective regulator organ is formed when the sorption agent is sealed within a separate bag. If this bag is pierced through by a sharp-edged cutting tool at the point of contact with the working agent vapour channel, the regulator organ will also open. The cutting tool can, of course, be placed also between the multi-layer film and the separate bag. For triggering the external film has to be deformable at the relevant positions without losing its air-tight nature.

The regulator organ can be expanded in addition to the actual closing element also by a thermostat valve. With the aid of the thermostat valve the temperature of the evaporator can be held at a control temperature. At higher temperatures the thermostat valve opens the path of the working agent vapour to the sorption agent, at lower temperatures the thermostat valve closes the path.

All known elements, which are subjected to change their displacement in case of a temperature change, are suitable as a thermostat. The best known ones are expanding bodies and bimetals. Memory alloys can be also advantageously used. In a particularly cost-effective manner bimetallic spirals can be used for the regulator organ. By virtue of this temperature fluctuations of less than 0.1 K can be achieved.

By building in a thermostat valve the cooling elements can be particularly advantageously used for the temperature-managed cooling of transport insulation containers. Insulated transport containers serve, for example, for the transporting of foodstuff or pharmaceutical products between +2° C. and +8° C. Insulated transport containers, fitted with the cooling elements according to the invention, can be stored for any period. To start the cooling function merely the regulator organ has to be opened and the product to be cooled packed in the interior. The thermostat valve controls the interior for several days within a narrow temperature range, independently from the prevailing external temperature. Because the insulation container can be made from an inexpensive material (e.g. polystyrene), a return transport, often expensive, can be dispensed with.

According to the invention all internal walls of an insulating container can be covered with evaporator surfaces. The temperature of the interior is then homogeneous even when the external temperature strongly fluctuates. Since the evaporator according to the invention has a flexible construction, at least one region of the evaporator can be a foldable one. If required, this region can be folded up and allow full access to the interior.

Under vacuum all flow channels to the sorption agent have to be retained. For this purpose spacers are provided, that let the working agent vapour flow unhindered away from the liquid working agent and at the same time let the cold surfaces contact the film with good thermal conductivity.

According to the invention for this purpose flexible plastic spacers are used, that are adapted to suit the respective cooling task. In any case, it is a prerequisite that the plastic spacers during storage would not release gas and would not have a deleterious affect on the vacuum. It is an advantage when as plastic polycarbonate, polyamide or polypropylene are use, as these materials can be heated to higher temperatures and degassed before or during the manufacturing processes.

Plastic spacers can be cost-effectively manufactured according to known manufacturing methods, like deep drawing, extrusion or thermal blow-moulding. In an advantageous manner care is taken during the manufacturing process that no materials, releasing gases afterwards, like plasticizers, are added.

In the thermal transport containers use currently the transported goods are cooled by ice batteries that have to be provided inside the container. As the size of these ice batteries is many times that of an evaporator according to the invention, either the internal volume is considerably reduced or a larger insulating container is required. Larger containers have, in turn, a greater external surface through which more heat flows into the interior that again has to be counteracted by larger ice batteries.

However, the fields of application are not limited to insulated containers. In principle any object can be fitted with cooling elements according to the invention. Advantageous is, for example, the cooling of tents, where complete tent walls can be replaced by the cooling elements according to the invention. The cooling of patients or injured people in a hot environment or the reduction of body temperature is just as possible as the use of cool vests, cool suits are breath coolers.

In principle they can be used anywhere where nowadays cooling batteries or ice batteries are used. When compared with cooling and ice batteries, the cooling elements according to the invention can be stored for any period of time and can be made to suit the cooling task, as the evaporator has a flexible construction.

During the sorption process sorption agents can achieve temperatures above 100° C. The multi-layer films, conventionally used in the packaging industry, are not always suited for such high temperatures. In particular polyethylene layers, used for sealing, become soft already at 80° C. and render the enclosure permeable under vacuum. In contrast to this, a sealing layer from polypropylene can withstand markedly higher temperatures. Their melting point is above 150° C.

In combination with high temperatures sharp edges, corners and tips of the granules of the sorption agent may cause inadmissible leakages in the films. This danger can be encountered by at least one polyester or polyamide layer within the multi-layer film. Polyamide films are especially resistant to tear and puncturing. The actual gas barrier is ensured by a layer of thin metal film or a metallized layer. For this purpose thin aluminum films with a thickness from 8 μm have proved themselves. Metallized plastic films are less dense. Nonetheless, in the case of short storage periods the use of these metallized films is also possible, especially since they can be more cost-effectively produced than metal films.

The individual layers of a multi-layer film are joined with one another using adhesives. Conventional adhesives contain solvents that during bonding are not completely removed from the adhesive coating. Over longer periods these solvents diffuse through the inside layers and compromise the vacuum within the cooling element. At higher temperatures, like those occurring in the sorption and manufacturing process of the cooling element, the diffusion is intensified. Therefore the adhesives used also have to be designed for high temperatures.

Advantageously, multi-layer films with a polyamide layer thickness of 12-50 μm, an aluminum layer thickness of 6-12 μm and a polypropylene layer thickness of 50-100 μm are used. Such films are used, for example, for the packaging of foodstuff, which after packaging are sterilized for preservation at temperatures above 120° C.

Multi-layer films according to the invention can be obtained, for example, from Wipf AG in Volketswil, Switzerland or from PAWAG Verpackungen GmbH, Wolfurt, Austria. When such films are used, cooling elements with a leakage rate below $10^{-8}$ mbarL/sec are achievable. Thus the storage life can be several years, without impairing the cooling ability.

The welding (sealing) of multi-layer films to form bags and the filling with loose goods, as well as the subsequent evacuation are state-of-the-art in the food industry. Therein numerous bag sizes and shapes are used. In particular flat bags, bags with pouring openings, bags with cardboard reinforcement, tear-open bags, bags with peel-effect for easy opening and bags with valves are to be mentioned. With their specific properties they all can have advantages for the cooling element according to the invention.

When filling the solid sorption agent into the bags, dust is produced, that settles on the internal surface of the film. Dust on subsequent sealing positions may lead to leakages if the layer of dust is too thick relative to the polypropylene layer. Polypropylene layer thicknesses of 50-100 μm are adequate to melt dust grains securely and vacuum-tight into the polypropylene layer.

When using films according to the invention, it is possible to envelop hot, sharp-edged and dust-releasing sorption agents without further protective intermediate layers directly under vacuum and store them over a period of several years, without external gases from the film material itself or through it reaching the cooling element that would impair the sorption reaction or completely prevent it.

As sorption agent preferably zeolite is used. In its regular crystalline structure it can reversibly sorb water up to 36% by mass. In the case of the application according to the invention the technically realizable water absorption is approx. 20-25%. Even at relatively high temperatures (above 100° C.) zeolites still have a considerable capacity to sorb water vapour and therefore are particularly suitable to be used in accordance with the invention.

Zeolite is a crystalline mineral that contains silicon and aluminum oxides in a framework structure. The very regular framework structure contains hollow spaces, in which water molecules can be sorbed while releasing heat. Within the framework structure the water molecules are subjected to strong field forces, the strength of which depends on the quantity of water already contained in the framework structure and the temperature of the zeolites.

Natural zeolite types, as they occur in nature, absorb considerably less water. Only 7-11 g water is sorbed per 100 g natural zeolite. This reduced water absorbing capacity is due to the specific crystal structure on the one hand and non-active impurities of the natural product on the other. Therefore for cooling elements, that over longer cooling periods can release the sorption heat through the enclosure, synthetic zeolites with their greater sorption capacity are preferred. For cooling elements with high cooling capacity and/or short cooling period, wherein the sorption agent remains relatively hot, according to the invention natural zeolites are also used. At high sorption agent temperatures synthetic zeolites are namely no longer more advantageous than natural ones. Typically, with a restrained release of the sorption heat and associated high sorption agent temperatures above 100° C., merely 4-5 g water vapour per 100 g dry sorption agent is sorbed by both types. From the economical point of view for such application the natural representatives have a marked advantage, since their price is considerably lower.

Natural zeolites have a further advantage. The non-active admixtures are typically between 10 to 30%. Although they are not actively involved in the generation of the cold, they are heated up by the adjacent zeolite crystals. Thus they act as a built-in, cost-effective heat buffer. The result of this is that the zeolite filling will become less hot and consequently can absorb additional water vapours at lower temperatures.

Natural zeolite granules is made up from broken and squashed fragments and consequently has sharp and pointed geometrical shapes, which under vacuum and increased temperatures can pierce or cut through the multi-layer film.

Among the approx. 30 different, natural zeolites the following can be advantageously used as cooling element according to the invention: clinoptilolite, chabzite, mordenite and phillipsite.

Naturally occurring materials can be returned to the nature without burdening the environment. After their use in cooling elements natural zeolites can be used, for example, as soil improver, liquid binder or to improve the water quality in stagnant waters. Of the synthetic zeolite types the types A, X and Y are to be recommended, each in its cost-effective Na form.

In addition to the zeolite/water combination other solid sorption pairs can also be used in the cooling elements according to the invention. Particular reference is made to bentonite and salts that also represent combinations with the working agent, water. Active carbon, in combination with alcohols, can be also an advantageous solution. Since these material pairs also operate in vacuum, they can be welded into the multi-layer film according to the invention.

According to the invention the amount of sorption agent is to be so measured and provided, that the water vapour flowing in has to overcome only a minimal pressure drop within the sorption agent. In this conjunction the pressure drop should be, particularly when water is the working agent, less than 5 mbar. In addition the sorption agent has to be able to offer sufficient surface to the working agent vapour for settling. To ensure an even sorption within the sorption agent and a small pressure drop, sorption agent granules have particularly proved themselves. Granule diameters between 2 and 10 mm provide the best results. These can be packed without any problem and after evacuation form a hard, pressure resistant body and stable in its shape of the sorption agent, that retains the shape imposed by the evacuation. However, to enable to produce variable geometries with the sorption agent bodies with the stable shape according to the invention the sorption agent is filled into several regions connected only via vapour flow channels. In this case, provided the vapour channel has a flexible construction, the individual firm regions can be displaced relative one another, folded and stacked, for example to make use of narrow spaces yet enable a good airflow.

Advantageous are also zeolite blocks, pre-formed from zeolite powder and resistant to deformation, into which the flow channels can be moulded and their shape is made to suit the required cooling element geometry. The stable zeolite blocks can have hollow spaces in the region of the working agent vapour channel so that not to hinder the flow.

During the sorption reaction sorption heat is released that heats the sorption agent. At higher sorption agent temperatures the absorbing capacity for water is strongly reduced. To maintain a high cooling capacity over a longer period, it is sensible to cool the sorption agent.

When the sorption agent is in direct contact with the multi-layer film, the sorption heat occurring can be removed unhindered through the film to the exterior. As a rule, the heat is carried off to the ambient air. It is also very efficient to cool the sorption container with water.

Because the heat transfer to an airflow from the outside of the sorption agent bag is of the same order of magnitude as the heat transfer of the granules of a sorption agent on the inside of the bag, in principle large film surfaces without ribs are recommended, like for example cylindrical, sheet or tubular geometries. Since zeolite granules have a particularly low heat conduction, the sorption containers are to be so designed, that the average heat conduction path within the sorption agent would not exceed 5 cm.

All applications are characterized in that a cooling element is stored over an unspecified period at any ambient temperature. At the time of commencement of the cooling effect the regulator organ is opened. Beginning from this point in time the working agent vapour can flow to the sorption agent and settle on it. The sorption agent becomes hot because it liquefies and adsorbs the vapour inside its crystal structure. The evaporator cools off and can be used as a cold source. In the case of cooling tasks taking place rapidly (e.g. cooling of a liquid), as a rule the period is not sufficient to cool the sorption agent with any consequence. Therefore the absorbing capacity for the working agent vapour is limited due to the hot sorption agent temperatures if additives do not act as heat buffer.

In the case of cooling elements with longer cooling period the sorption agent can release heat through the multi-layer film and depending on the application transfer this heat at higher temperature level to a product that has to be kept warm.

When being used in the deep-freezing range, adequately dimensioned flow channels and possibly additives, lowering the freezing point, are to be considered in the working agent. With these additives evaporation temperatures below 0° C. can be achieved even when the working agent is water, without the water freezing.

Particularly when being used in temperature-managed transport it may happen that the ambient temperatures are below the control temperature of the thermostats. With falling temperatures first the thermostat closes and the active cooling of the cooling element is interrupted. As soon as the temperature in the evaporator falls below 0° C., if pure water is used, it would solidify and release the solidification heat at 0° C. to the interior. Provided the water fill is adequate, the internal temperature will not fall below the freezing point.

For transport tasks, where 0° C. is too low, instead of pure water an aqueous, eutectic mixture may be used, the transformation point of which is set slightly below the control temperature of the thermostats (e.g. transformation point 3-4° C. and a thermostat control temperature of 5° C.). Thus, provided the temperature of the interior is above the control temperature of the thermostats, in the case of this configuration working agent will evaporate from the aqueous mixture and cool the interior. At temperatures below the control point the thermostat closes the vapour channel. When now the external temperature falls below the transformation point and heat keeps flowing from the mixture into the environment, the temperature falls in the evaporator until the mixture falls below the transformation point. The mixture is now converted and releases heat to the interior. Consequently, in the case of appropriate dimensioning a cooling element according to the invention can cool not only at a constant temperature, but provide transformation heat when it falls short of this temperature and keep the transported goods at least at the transformation temperature.

For applications, wherein no enlargement of the evaporator volume by additional eutectic mixtures is desired, according to the invention a separate heat source may also be provided between the evaporator and the insulation of the container. In the simplest case this heat source itself does not need its own control, as its excess heat will be carried away by its thermostatic control before the higher temperatures would reach the transported goods. The capacity of this heat source should be so calculated, that its heat emission should be sufficient to keep the insulated container at the expected lowest ambient temperatures at least at the required temperature of the internal space. According to the invention the heat source does not have to be homogeneously arranged either within the insulated container. It is rather sufficient to have a point-by-point heat release, since the evaporator acts as a steam heating that distributes and controls the amount of heat absorbed by the heat source over the surface of the evaporator. Water, evaporating in thermal contact with the heat source, condenses within the evaporator structure on the cooler surfaces and heats them to the level of the site to be evaporated. Thus the temperature of the entire evaporator remains homogeneous. As soon as the temperature on the thermostat exceeds its control temperature, the regulator organ opens and lets the working agent vapour flow into the sorption agent until the control temperature is reached again.

For this purpose heating elements, charged by batteries transported with them, are, of course, extremely well suited. In the case of this type of heat source the heating element can be controlled also by an additional, electric thermostat.

In principle all known exothermally operating chemical reactions, which are used to keep bodies warm (e.g. open flame, catalytic combustion, etc.) are suitable as separate heat sources. Particularly advantageous is the oxidation of iron powder with the oxygen of the air in the presence of water, salts and active carbon. The slowly progressing oxidation requires only little oxygen that either diffuses into the interior through the usually porous insulation walls or is directed from the outside onto the heat source via suitably dimensioned openings.

According to the invention the output of these heat sources can be controlled by means of the air supply (oxygen supply). When no heat is required, the air supply can be completely stopped, but further increased when falling below a limit temperature. By controlling the air supply both the cooling capacity of the cooling element and the heating capacity of the heat source can be reduced.

Without control a once activated heat source would heat even when the ambient temperature is again well above the desired temperature of the internal space. In these cases the cooling element would have to carry away the heat coming from the outside as well as the reaction heat released by the heat source. Because during a transport lasting several days the ambient temperatures can fall and rise several times above and below the required temperature of the internal space, a control of the heat source is a sensible one.

According to the invention the air supply for the oxidation process of the heat source can be regulated via its own air thermostat that, depending on the ambient temperature, enables a greater or lesser air supply to the heat source. Advantageously the heat source is inside the insulated container, distributed on one or several surfaces between the inside wall of the insulating box and the evaporator. The air thermostat can comprise a bimetallic element that above a limit temperature closes the external end of an air channel. To enable the flow of oxygen-deficient air from the interior, the airtight bag can be provided with an opening, through which used air can escape into the interior of the insulating container. From there the air can reach the outside through the natural pores of the insulating material, or appropriate outlet openings are made to allow the exchange of air and are deliberately opened when starting the heat element. The deliberate opening of the openings could also prevent during storage the unintentional automatic activation of the heat source at low storage temperatures.

Ideally the inlet opening and the outlet opening are at different height levels. In this case a natural air movement will take place and when the air thermostats are open, supported by the thermal lift of the air heated on the heat source, new oxygen always is transported to the embedded iron powder.

Ideally the supply of fresh air through the air thermostats will commence when the ambient temperature falls below the average value of the control temperature set. The lower the external temperature falls, the wider the air thermostat should open so that to increase the output of the heat source. At the same time a precise control of the output is not necessary, as the precise temperature control is assumed by the thermostat valve in the cooling element. A too high an output of the heat source is carried away by the cooling element before the useful volume would be affected by it. Therefore the heat source is preferably provided between the wall of the insulating container and the evaporator surface.

Only in rare cases is the working agent present in the evaporator in a free form. In most cases it is distributed in an absorbent non-woven fabric and fixed by hygroscopic forces. Particularly cost-effective materials are absorbent papers, like they are used in many cases in households and industry to absorb liquids. The water-storing non-woven fabrics, just like the plastic spacer or natural zeolite, must not release gases under vacuum and higher temperatures. For this purpose particularly suitable are commercially available polypropylene micro-fibres. These fibres are prepared to absorb water and do not release gases that would interfere with the vacuum.

In an advantageous manner in the region of the heat source a somewhat greater amount of non-woven fabric is allocated to the evaporator because more liquid working agent is available there for the vapour heating. In addition, the geometry of the non-woven fabric can be so designed, that a decreasing amount of working agent will be continued to be supplied by virtue of the suction effect of the non-woven fabric.

A further solution is the fixing of the working agent in organic bonding agents, like "Water Lock" of the company Grain Processing Corp, USA. In an advantageous manner several of the above mentioned steps can be combined.

To maintain the required cross-section of the vapour channel between the evaporator and the sorption agent fill despite the external air pressure, according to the invention the vapour channel can be formed and stabilized by several layers of a plastic net. By doing so, adequate cross-section remains for the flow between the net structure. When using polypropylene nets higher temperatures can be permitted without releasing gases. By virtue of the flexible structure of the nets they optimally fit to suit the relevant geometry.

According to the invention the evaporator can be of any shape and made from various materials. Technically it is necessary that during the cooling process a sufficiently large opening remains in the working agent vapour channel for the escape of the water vapour, the working agent in the liquid state remains at the position to be cooled, a carrying away of liquid components is prevented and a good thermal bonding to the object to be cooled is possible.

As a rule the sealing of the multi-layer film is carried out thermally by pressing hot sealing beams on the external film surfaces until the superposed sealing layers become fluid and melt with one another.

The welding process can be carried out inside a vacuum chamber under vacuum. At the same time in this case all gases, which would prevent the subsequent adsorption process, are evacuated in the vacuum chamber from the water and all other further components.

It is also advantageous to evacuate the bag without a vacuum chamber by means of a suction device at a position of the sealing seam that is still open. To keep the suction channel open, a polypropylene spacer, advantageously similar to the material of the structure is placed between the surfaces of the film, said spacer expanding the flow channel inside the cooling element. As soon as the evacuation is completed, the surfaces of the film, including the spacer, are heated by the sealing beams, until the sealing layer and the identical material of the spacer melt with one another and after cooling off produce a gas-tight joint.

DETAILED DESCRIPTION OF THE PREFERRED EMBODIMENTS

Figure 1:
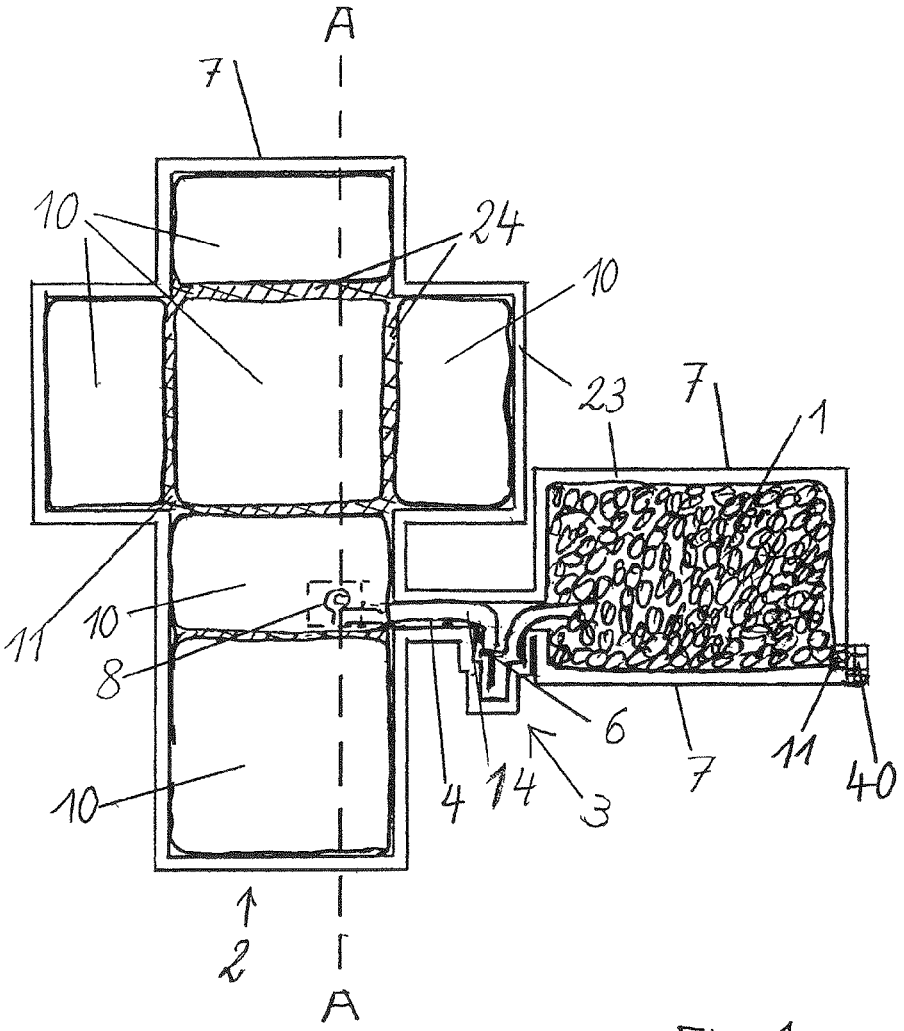
FIG. 1—a cooling element according to the invention, still in the flat state, for the cooling of an insulated transport box, FIG. 1*a*—a cooling element with almost identical construction, with a separate zeolite bag, FIG. 2—the flexible evaporator of FIG. 1 in perspective and sectioned illustration, FIG. 3—the cooling element according to FIG. 1 together with an insulated transport box, FIG. 3*a*—a heat source, FIG. 3*b*—a heat source inside an insulated box, FIG. 4—a thermostat valve, FIG. 5—a regulator organ for a single-use cooler, FIG. 6—a further configuration of an evaporator, illustrated sectioned, and FIG. 7—a region of the sorption agent with three sorption agent bags.

The cooling element, illustrated in FIG. 1 (and in FIG. 1*a*) has its flat shape still as it is obtained from the manufacturing process. Two fitting, cut to size, multi-layer films 7 are superposed with their sealing layers facing one another and fitted with individual components of the cooling element. In the drawing the top multi-layer film 7 is illustrated transparent, so that to display the position of the components. Both multi-layer films 7 comprise four single layers, bonded together. The films are hermetically sealed (welded) on the continuous edges to form a sealing seam 23 by the innermost polypropylene layer. A gas-tight aluminum layer is enveloped by two polyamide layers, which in turn protect the aluminum layer from destruction and allow printing on the multi-layer film. The evaporator 2 comprises two superposed single-piece spacers 11, onto which six non-woven fabric plates 10 are placed. The non-woven fabric 10 comprises a plurality of layers of a hydrophilic micro-fiber mats from polypropylene. It is impregnated with water, being the working agent. Due to the external pressure on the capillary structure of the micro-fibers the maximum water absorption is limited. The volume of water filled is somewhat greater than it could be absorbed by the amount of the sorption agent. At low ambient temperatures the excess water can freeze and keep the interior of the insulating box during glaciation at 0° C. The six non-woven fabric plates 10 are kept at a distance by specified folding lines 24. Below a non-woven fabric a thermostat valve 8 is placed, from which a working agent vapour channel 4 leads to a regulator organ 3 and from there into the sorption agent 1. The working agent vapour channel 4 is expanded by a flexible plastic hose line 14 that withstands the external pressure and is not squashed even when folded. Under vacuum the multi-layer film 7 nestles against the components in such a manner, that the water vapour can reach the sorption agent 1 only via the thermostat valve 8, the hose line 14 and the regulator organ 3.

For the production of the cooling element according to the invention the multi-layer films 7, cut to size, are pre-sealed segment by segment, fitted with the individual components and then welded in the region of the sealing seam 23 up to a small suction opening 40. To the suction opening 40 a vacuum pump is connected, that evacuates from the cooling element the air and gases that may be released. Following this the suction opening 40, through which a portion of a spacer 11 protrudes so that to keep the suction channel open, is heated by suitable welding beams to that extent, that the material of the spacer 11 melts with the sealing layer. Under certain geometric conditions it may be advantageous to evacuate the evaporator 2 and the sorption agent 1 at separate positions.

Figure 1A:
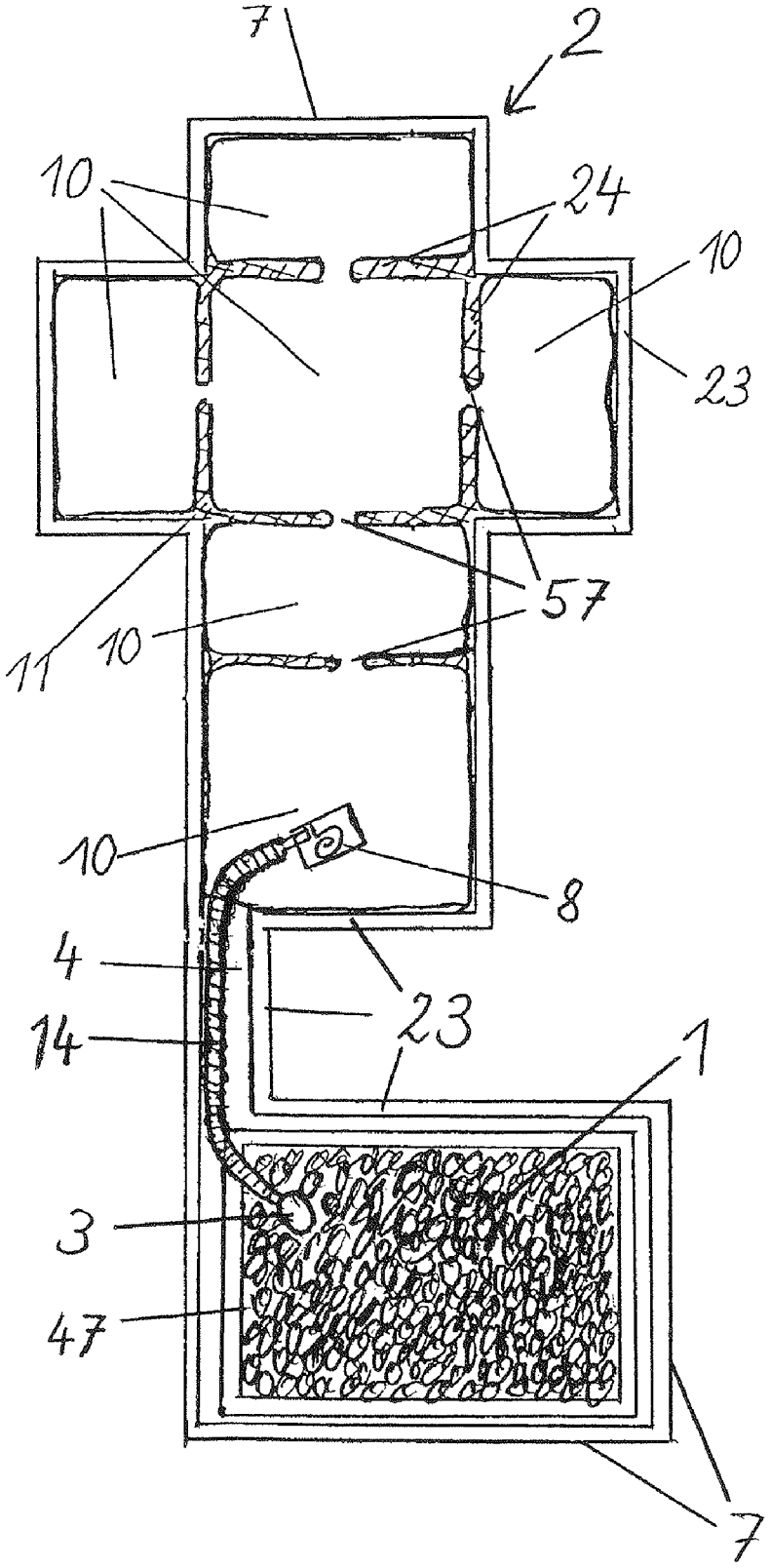

FIG. 1*a* shows variations, differing from the single-use cooler of FIG. 1 in the following: The flexible hose line 14 originates now from another position from the evaporating region 2 into the sorption agent 1. The sorption agent 1, in this case zeolite, had been filled into a separate bag 47 and additionally enveloped by the multi-layer film 7. To produce the vapour connection, the bag 47 has to be passed through by the regulator organ 3. For this purpose the regulator organ 3 has sharp edges, which by a forceful, external impact on the covering multi-layer film 7 pierce the enclosure of the bag 47. In this configuration the flexible hose line 14 between the evaporator 2 and the regulator organ 3 is a plastic corrugated hose, that due to its structure withstands the external air pressure even in the case of thin material thickness yet it allows an extremely flexible connection to the working agent vapour. The six non-woven fabric plates 10 are in contact on the folding lines 24 with further non-woven fabrics 57, so that to evenly distribute the liquid working agent again by virtue of the suction effect of the material in case a partially acting heat source should vapourise on the contacts and recondense at other positions.

The manufacture of the single-use cooler according to FIG. 1*a* also differs from the manufacturing method of the single-use cooler according to FIG. 1. The bag 47 can be manufactured separately. It does not have to be evacuated and sealed simultaneously with the sealing of the cooling element. In a separate manufacturing process it can be filled with hot zeolite, evacuated and sealed. During the finishing of the cooling element the cooled bag 47 is placed, together with the other components, between the multi-layer films 7 and aligned with the regulator organ 3 and the flexible hose line 14. In this example the evacuation is carried out within a vacuum chamber, in which all components placed into it, including water, the working component, are relieved of adhering and included, gas-producing residues. The cooling element is welded to the still open sealing seams while in the vacuum chamber and removed as a completed unit from the flooded again vacuum chamber.

Figure 2:
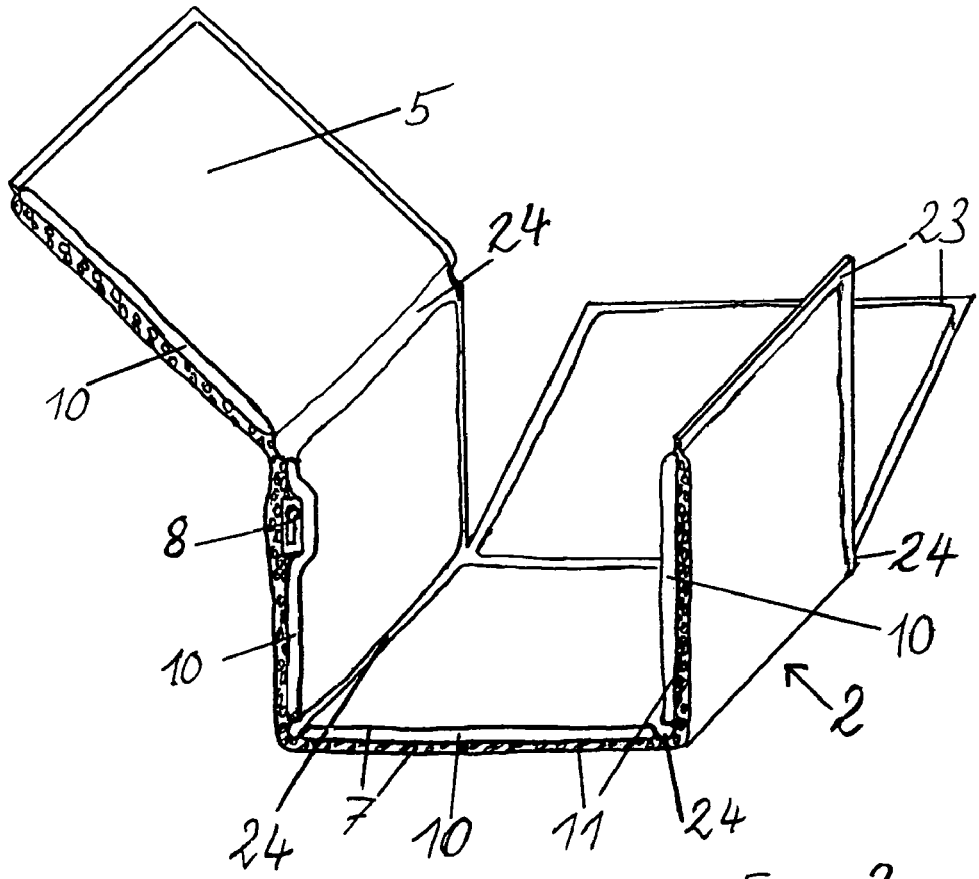

FIG. 2 shows the evaporator 2 according to FIG. 1 sectioned along the line AA and in a perspective view. The evaporator 2 is folded into its cubic shape along the folding lines 24. On the sectioned surfaces the spacer 11 and the non-woven fabric 10, impregnated with water, are visible. All this is enclosed by the multi-layer film 7. In the region of the folding positions 24 there is no non-woven fabric 10, so that the top multi-layer film 7 can press through up to the spacer 11, thus compensating for the length contraction occurring relative the outside film. In this manner a slight deformation of the evaporator 2 can be achieved without the formation of creases. The thermostat valve 8 is inserted on the left wall of the evaporator 2 between the non-woven fabric 10 and the spacer 11. All areas of the non-woven fabric 10 are in connection with the thermostat valve 8 via the spacer 11.

FIG. 3 shows the cooling element according to FIG. 1 in the folded state prior to placing it into an insulated transport box 12 that can be covered by a lid 25. On one of its edges the transport box 12 has a free space 26, into which the working agent vapour channel 4 can be inserted. Thus the regulator organ 3 and the sorption agent 1 will abut against a lateral wall in the outside region of the transport box 12. The six planes of the evaporator 2, folded into a parallelepiped block, line the six internal surfaces of the transport box 12. The resulting interior serves the purpose of accommodating the transported goods. The top evaporator plate 5 can be folded open. The entire interior can be accessed through it. On two lateral walls of the transport box 12 cut-outs 27 are provided, each of them being able to accommodate a heat source 18. The heat sources 18 contain in an air-permeable cover a mixture of iron powder, water, salt, cellulose and active carbon. As a result of the access by air the iron powder oxidizes exothermally. Through the porous styrene insulation of the transport box 12 and/or through additional thin air channels 28 the cut-outs 27 the oxygen of the air reaches the iron powder. The heat sources 18 ensure a heating of the interior in that case when the transport box 12 is in an environment that is too cold relative the control temperature of the thermostat 8. The heat generation of the heat sources 18 itself remains uncontrolled. When the heat sources 18 provide more heat than is required for the interior, the thermostat valve 8 opens and lets so much vapour to escape into the sorption agent 1 until the temperature of the evaporator will be again in the control range. Because the evaporator 2 contains only water and steam, the temperature remains homogeneous in the entire evaporator 2. From the evaporator sections, where more heat occurs, for example from the heat sources 18, the water evaporates while absorbing heat and in those sections, from which heat flows out to the environment, steam will enter and condense exothermally. Due to the capillary suction effect of the non-woven fabric the water concentration can again equalize.

Figure 3A:
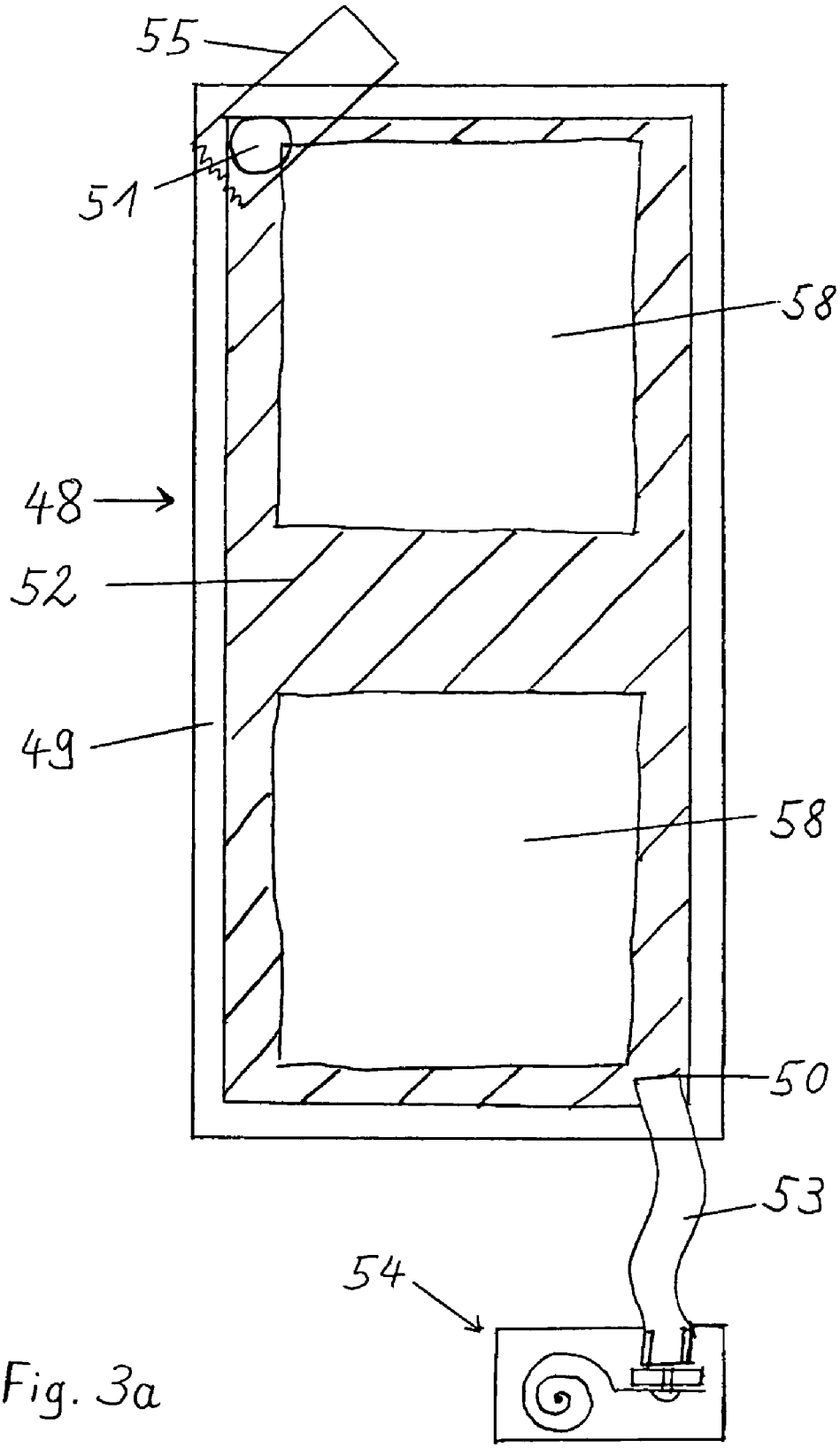

FIG. 3*a* shows an alternative embodiment of a heat source 48 in a gas-tight film enclosure 49 sealed on the edges, that has an entry opening 50 and outlet opening 51. The heat source 48 contains two paper bags filled with reactive iron powder mixtures 58, which upon entry of oxygen experience an exothermic reaction. To ensure air access, further flow paths are kept open inside the film enclosure 49. In the embodiment the flow paths are expanded by a flexible lattice 52. The entry opening 50 is joined in a gas-tight manner with a hose line 53, that at its external end can be closed off by an air thermostat 54. The outlet opening 51 is closed off by an adhesive tape. It is pulled off only to start the heat source 48. The air thermostat 54 can be also closed off by an additional enclosure (not illustrated) until it is used. The heat source is so dimensioned, that it can be folded in the centre and thus can cover two internal surfaces of an insulated box.

Figure 3B:
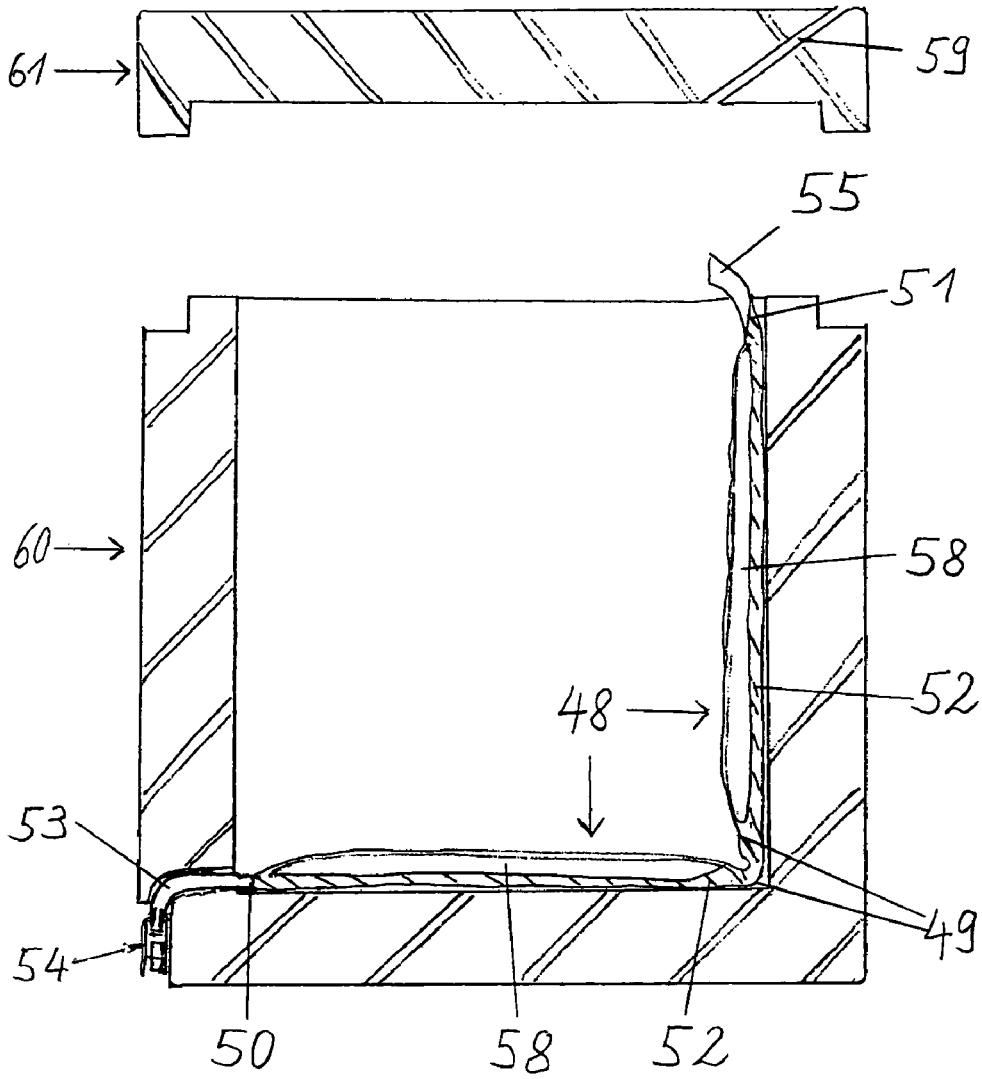

FIG. 3*b* shows the heat source 48 of FIG. 3*a* placed into an insulated box 60, illustrated sectioned. The air thermostat 54 is provided in a bottom corner on the outside of the box 60. It contains a bimetallic spiral filament that opens the entry opening 50 below a temperature of 5° C. The hose line 53 forms the gas-tight connection from the air thermostat 54 situated outside through the insulation of the box 60 at the entry opening 50. The heat source 48 is folded in the centre and covers the bottom and one lateral wall of the box 60. The flexible lattice 52 and both iron powder mixtures 58 are enveloped by the gas-tight film enclosure 49. At the top end of the heat source 48 there is the outlet opening 51. At this stage it is closed off by the adhesive tape 55. To start the heat source 48 the adhesive tape 55 has to be pulled off. Due to the entering air the exothermic reaction commences and heats the air situated in the lattice, the heated air rises, flows out through the outlet opening 51 in the box and from there flows outside through a small ventilation channel 59 in the lid 61 of the box 60 and at the same time, with the air thermostat 54 open, lets new air, rich in oxygen, flow in through the hose line 53. The illustration of the cooling element, lining the box 60 and abutting against the heat source 48, is omitted.

Figure 4:
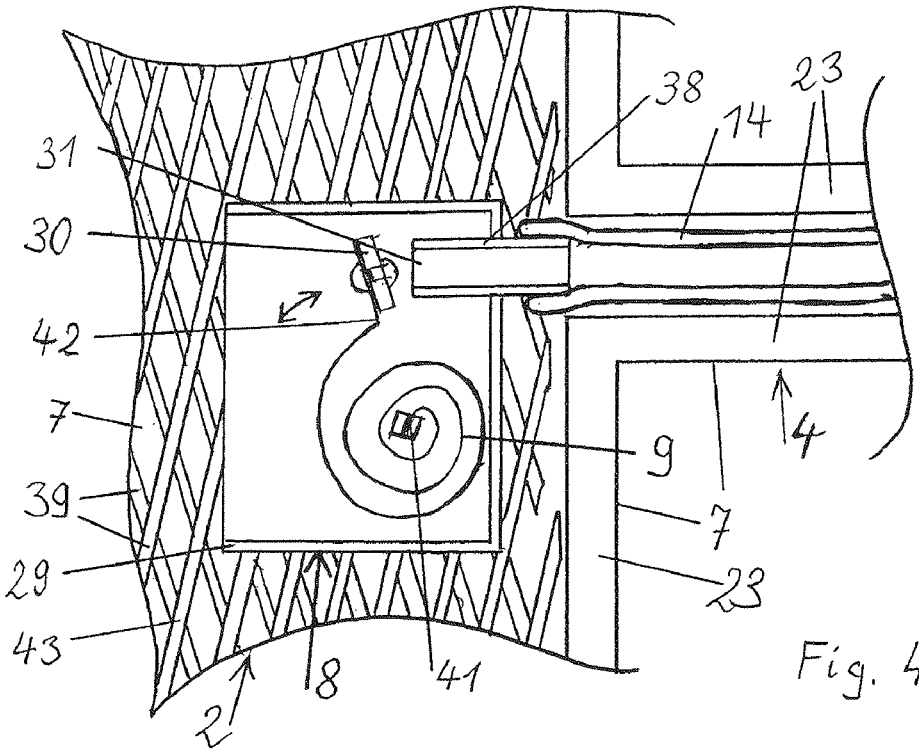

FIG. 4 shows a thermostat valve 8, cross-sectioned. A bimetallic strip 9, curled in the shape of a spiral, is firmly joined on its inner end 41 to a housing 29 that is open on one side, while the free end 42 contains a sealing disc 30 that at the control temperature closes off the opening 31 of the working agent vapour channel 4. The opening 31 is formed by a piece of pipe 38 bonded gas-tight in the housing 29, the pipe having a plastic hose 14 pushed on to its other end. The multi-layer film 7, which is sealed gas-tight on the edges 23, nestles again around the hose 14. Further on the multi-layer film 7 and the hose 14 can be so strongly pressed by squashing elements (not illustrated) from the outside, that the working agent vapour channel 4 can be blocked from the outside. To start the cooling, the squashing elements are removed. Due to the restoring force of the plastic hose 14 the flow path for the working agent vapour will open. The regulator organ according to the invention is formed in this embodiment by the thermostat valve 8 and the squashing elements. Under the housing 29 of the thermostat valve 8 there is a layer of a plastic net 43. Since the threads 39 of the net 43 are superposed at the points of intersection, the working agent vapour channels will also remain within the plane of the net. Good results are achieved with nets having a thread thickness of approx. 2 mm with a distance of approx. 3 mm between the threads. Although the micro-fibres of the non-woven fabric are pressed against one side of the plastic net 43 and the flexible multi-layer film against the other side, sufficient cross-section remains for the working agent vapour. When the cross-section becomes too small in some regions, e.g. in the in-flow region to the thermostat valve 8, several layers of the plastic net 43 can be superposed. The flexibility according to the invention of the evaporator 2 remains despite this.

Figure 5:
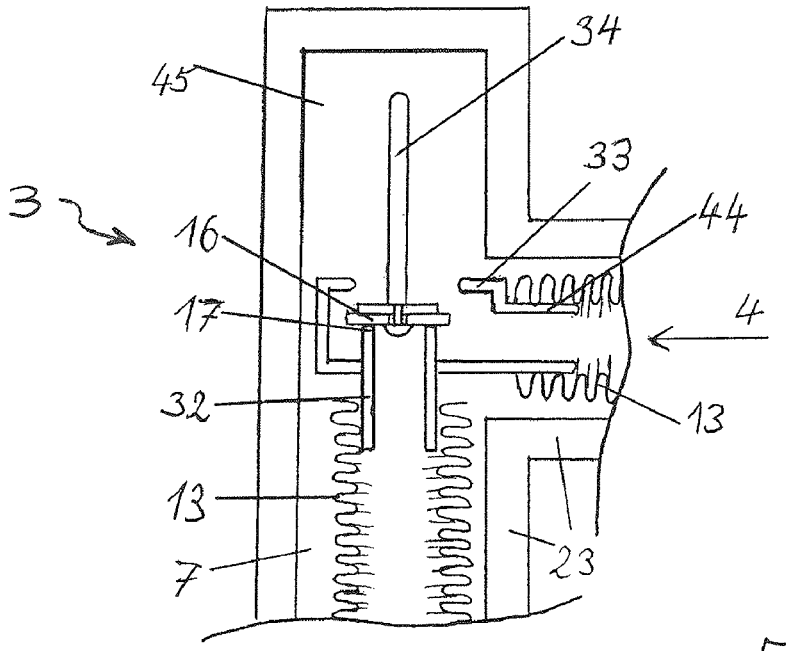

FIG. 5 shows a regulator organ 3, sectioned, that is held closed by that the external air pressure deforms the multi-layer film 7 to that extent, that a disc-shaped sealing plane 16 is pressed against a sealing seat 17. The sealing seat 17 is again formed by a piece of pipe 32, on the second end of which a flexible plastic corrugated hose 13 is pushed. A corrugated plastic hose 13 is pushed also on the perpendicular extension 44 of the working agent vapour channel 4. The extension 44 commences from a plastic housing 33, in which the sealing plane 16 can be lifted off or folded back from the sealing seat 17 without being hindered by the multi-layer foil 7. The lifting force, necessary for folding, is applied via a lifting rod 34 joined with the sealing plane 16. The lifting rod 34 is embedded into a side-pocket 45 of the multi-layer film 7, appropriately cut to suit. This side pocket 45 is also sealed vacuum-tight on the edges 23. Under vacuum the sealing plane 16 is pressed against the sealing seat 17 by means of the multi-layer film 7 and the lifting rod 34. A slight tilting movement on the lifting lever 34 from the plane of the drawing deforms the multi-layer film 7 to that extent, that the path for the working agent vapour can be totally or gradually opened. In the case of an optimal construction of the regulator organ 3 the sealing plane 16 automatically closes as soon as the tilting force on the lifting lever 34 ceases to exist.

Figure 6:
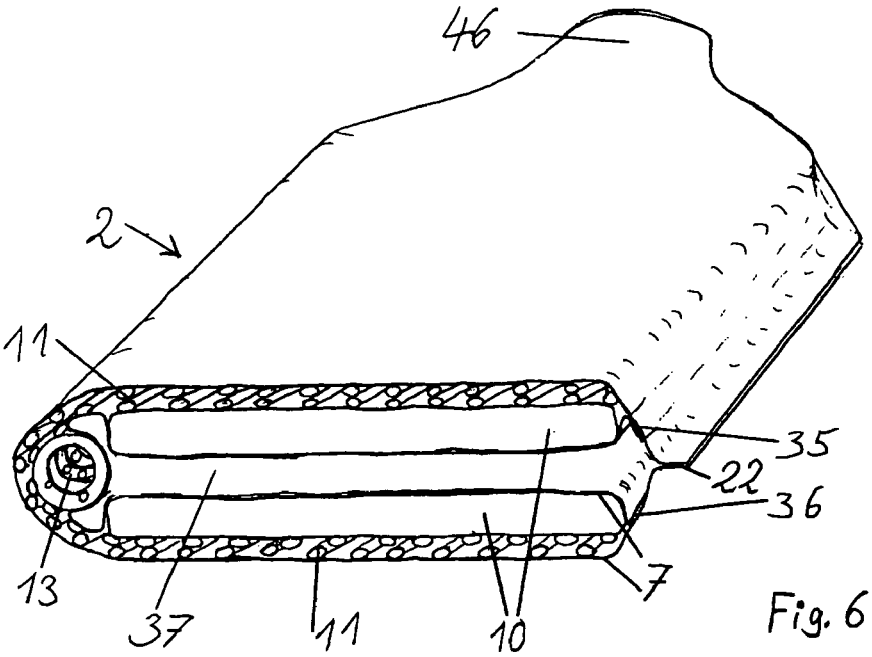

FIG. 6 shows a further configuration of an evaporator 2 shown sectioned and in perspective, that absorbs heat from an airflow to be cooled. The flow channel 37 for the airflow is formed and expanded by the evaporator 2 itself. For this purpose the evaporator 2, produced originally flat, after evacuation is folded 180° about a central working agent vapour channel, that in this configuration is formed by a perforated corrugated hose 13. The originally opposite situated sealing seams 35 and 36 are now positioned directly opposite one another. Because the internal ends of the film are cut shorter than the external ones, the external ends 22 of the multi-layer film 7 can be welded again and in this manner form the hermetically closed flow channel 37 for the airflow. At the rear end 46 of the flow channel 37 the flat airflow is converted into a round flow geometry.

In the configuration shown the working agent vapour channel is formed by two layers of a net-shaped spacer 11. The woven fabrics 10 are in thermal contact with the flow channel 37.

Figure 7:
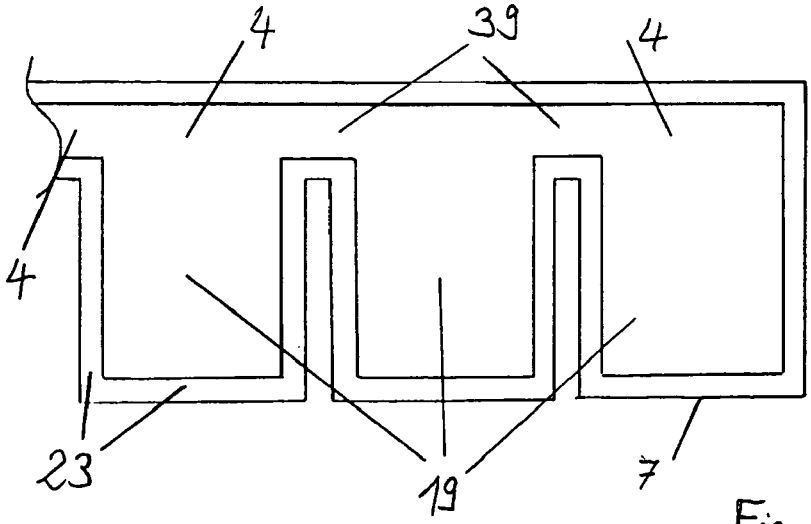

Finally, FIG. 7 shows in the form of a sketch, the region of a cooling element, filled with sorption agent. The multi-layer film 7 is divided into three pockets 19, which are connected with one another only via the working agent vapour channel 4. The working agent vapour channel 4 can be formed by a perforated corrugated hose (not illustrated), that due to its corrugation is extremely stable against pressure yet at the same time is flexible. The three sorption agent pockets 19 contain bulk zeolite that under vacuum is stable against pressure but is inflexible. In the bypass regions 39, where there is no zeolite filling, the structure remains flexible due to the flexible corrugated hose. The entire cooling element can be folded on these bypass regions 39, to enable an optimal adaptation to suit the relevant task.

What is claimed is:

1. A cooling element with a sorption agent, that under vacuum can sorb a vapour-like working agent that evaporates from a liquid working agent in an evaporator and with a regulator organ in a working agent vapour channel between the sorption agent and the evaporator, wherein the entire cooling element is hermetically enclosed by a gas-tight multi-layer film, the multi-layer film having a flexible construction and being under vacuum so as to enclose the regulator organ, the working agent vapour channel and the evaporator, and wherein the evaporator and the working agent vapour channel remain flexible and the working agent vapour can flow to the sorption agent only through the regulator organ, wherein at least one surface of the evaporator has a foldable construction such that the flexible evaporator covers a plurality of internal surfaces of a thermally insulated container, wherein the evaporator comprises a plurality of plates separated by folding portions for providing said foldable construction to said evaporator, and wherein the evaporator contains a thermostat valve for controlling the temperature of the evaporator, the thermostat valve opening and closing a path of working agent vapour from the evaporator to the sorption agent in response to a temperature change of the evaporator.

2. The cooling element according to claim 1, wherein the regulator organ has a valve lifting rod that can be actuated by deforming the multi-layer film.

3. The cooling element according to claim 1, wherein the thermostat valve comprises a control body from bi-metal and is in thermal contact with the liquid working agent.

4. The cooling element according to claim 1, wherein the sorption agent comprises zeolite and the working agent comprises water.

5. The cooling element according to claim 1, wherein the evaporator comprises a non-woven fabric from which the working agent can evaporate and a spacer, that forms working agent channels between the non-woven fabric and the multi-layer film.

6. The cooling element according to claim 1, wherein the liquid working agent comprises substances which move the solidification point by +2 to +4° C.

7. The cooling element according to claim 1, wherein the working agent vapour channel comprises a flexible corrugated hose.

8. The cooling element according to claim 1, wherein the working agent vapour channel comprises a piece of hose that can be squashed by external squashing elements to prevent the flow of the working agent vapour.

9. The cooling element according to claim 1, wherein the regulator organ comprises a sealing plane that is pressed by the multi-layer film against a sealing seat.

10. The cooling element according to claim 1, wherein the thermally insulated container defines an interior space and has a heat source that heats its interior space at lower ambient temperatures.

11. The cooling element according to claim 10, wherein the heat source comprises iron powder that supports an exothermic reaction upon the entry of oxygen of the air.

12. The cooling element according to claim 11, wherein the heat source is enveloped by a gas-tight film cover and the access of the oxygen of the air is controlled by an air thermostat.

13. The cooling element according to claim 12, wherein, at ambient temperatures below the required working space temperature, the air thermostat opens and lets fresh airflow to the iron powder and at ambient temperatures above the working space temperature prevents fresh air to flow in.

14. The cooling element according to claim 13, wherein the gas-tight film cover has an entry opening and an outlet opening for oxygen-deficient air.

15. The cooling element according to claim 14, wherein, during storage, the outlet opening is closed and it is opened at the commencement of the heat source.

16. The cooling element according to claim 13, wherein the insulated container comprises a ventilation channel for the exit of oxygen-deficient air.

17. The cooling element according to claim 1, wherein the sorption element is provided in several portions inside the multi-layer film and the portions remain displaceable relative one another and can be reached by the working agent vapour via flexible working agent vapour channels.

18. The cooling element according to claim 17, wherein at least one working agent vapour channel is formed by flexible plastic nets that keep open an adequate cross-section for the flow of the working agent vapour.

19. The cooling element according to claim 1, wherein, on the multi-layer film in the external region of the evaporator, an air channel is provided, through which heat can be absorbed in the evaporator.

20. A method to evacuate a cooling element according to claim 1, wherein, in the region of a sealing seam, the multi-layer film has a polypropylene spacer via which a vacuum pump evacuates the interior of the cooling element and that after evacuation the spacer is heated until it melts with the sealing seam of the multi-layer film and forms a gas-tight, evacuated cooling element.

21. A transport container assembly comprising:

a thermally insulated container having a plurality of internal surfaces defining an interior; and a cooling element disposed within said container interior, said cooling element including an evaporator having a liquid working agent, a sorption agent chamber containing a sorption agent for sorbing a vapour-like working agent evaporating from said liquid working agent under vacuum, a working agent vapour channel connecting said evaporator and said sorption agent chamber and a regulator organ disposed in said working agent vapour channel, wherein said entire cooling element is hermetically enclosed under vacuum by a gas-tight multi-layer film so as to enclose said evaporator, said sorption agent chamber, said working agent vapour channel and said regulator organ, said multi-layer film having a flexible construction such that said evaporator and said working agent vapour channel remain flexible and said working agent vapour can flow to said sorption agent only through said regulator organ, wherein the evaporator comprises a plurality of plates separated by folding portions for providing said foldable construction to said evaporator, and wherein said evaporator has a foldable construction such that at least two of said plurality of internal surfaces of said thermally insulated container are covered by said evaporator, and wherein said evaporator contains a thermostat valve for controlling the temperature of said evaporator, said thermostat valve opening and closing a path of working agent vapour from said evaporator to said sorption agent chamber in response to a temperature change of said evaporator.

22. A transport container assembly comprising:

a thermally insulated container having a plurality of internal surfaces defining an interior; and a cooling element disposed within said container interior, said cooling element including an evaporator having a liquid working agent, a sorption agent chamber containing a sorption agent for sorbing a vapour-like working agent evaporating from said liquid working agent under vacuum, a working agent vapour channel connecting said evaporator and said sorption agent chamber and a regulator organ disposed between said evaporator and said sorption agent chamber, wherein said entire cooling element is hermetically enclosed under vacuum by a gas-tight multi-layer film so as to enclose said evaporator, said sorption agent chamber, said working agent vapour channel and said regulator organ, said multi-layer film having a flexible construction such that said evaporator and said working agent vapour channel remain flexible and said working agent vapour can flow to said sorption agent only through said regulator organ, wherein the evaporator comprises a plurality of plates separated by folding portions for providing said foldable construction to said evaporator, and wherein said evaporator contains a thermostat valve for controlling the temperature of said evaporator, said thermostat valve opening and closing a path of working agent vapour form said evaporator to said sorption agent chamber in response to a temperature change of said evaporator.

23. A transport container assembly as defined in claim 22, wherein said regulator organ further comprises a lifting rod including a sealing plane pressed against a sealing seat disposed in said working agent vapour channel, said lifting rod being manually actuated by deforming said multi-layer film to lift the sealing plane off the sealing seat.

* * * * *